US007219577B2

(12) United States Patent
Maier-Hunke

(10) Patent No.: US 7,219,577 B2
(45) Date of Patent: May 22, 2007

(54) HAND WHEEL, ESPECIALLY FOR INITIATING A ROTATIONAL MOVEMENT IN THE HOLDER OF A ROLLER FILE

(75) Inventor: Horst-Werner Maier-Hunke, Iserlohn (DE)

(73) Assignee: "Durable" Hunke & Jochheim Gmbh & Co. KG, Iserlohn (DE)

( * ) Notice: Subject to any disclaimer, the term of this patent is extended or adjusted under 35 U.S.C. 154(b) by 467 days.

(21) Appl. No.: 10/487,503

(22) PCT Filed: Oct. 18, 2002

(86) PCT No.: PCT/DE02/04006

§ 371 (c)(1),
(2), (4) Date: Feb. 20, 2004

(87) PCT Pub. No.: WO03/038540

PCT Pub. Date: May 8, 2003

(65) Prior Publication Data

US 2004/0200311 A1 Oct. 14, 2004

(30) Foreign Application Priority Data

Oct. 23, 2001 (DE) ..... 101 53 532

(51) Int. Cl.
*G05G 1/10* (2006.01)

(52) U.S. Cl. ..... 74/553

(58) Field of Classification Search ..... 74/552, 74/553, 558, 551.9; 16/430, 432, 433; 200/564; 40/377, 378, 379, 493, 506

See application file for complete search history.

(56) References Cited

U.S. PATENT DOCUMENTS

| | | | | |
|---|---|---|---|---|
| 3,887,963 | A | 6/1975 | Harmon et al. | |
| 4,012,806 | A | 3/1977 | Howie, Jr. | |
| 5,561,929 | A * | 10/1996 | Bell et al. | 40/379 |
| 5,741,003 | A * | 4/1998 | Segien, Jr. | 251/95 |
| D423,588 | S * | 4/2000 | Koehneke et al. | D19/99 |
| 6,105,460 | A * | 8/2000 | Li | 74/551.9 |
| 6,192,774 | B1 | 2/2001 | Bauer et al. | |
| 6,453,512 | B1 * | 9/2002 | Kaelin et al. | 16/441 |

FOREIGN PATENT DOCUMENTS

EP 1094372 4/2001

* cited by examiner

*Primary Examiner*—Vicky A. Johnson
(74) *Attorney, Agent, or Firm*—Mark P. Stone

(57) ABSTRACT

In order to increase the grip of a hand wheel (4) which is especially intended for a roller file, said hand wheel consists of a base body (6), an outer shell (9) and a rubber-elastic insert (12) disposed between the base body (6) and the outer shell (9). Said insert is provided with protuberances (11) which jut out in the outer shell (9).

21 Claims, 2 Drawing Sheets

HAND WHEEL, ESPECIALLY FOR INITIATING A ROTATIONAL MOVEMENT IN THE HOLDER OF A ROLLER FILE

TECHNICAL FIELD

The invention relates to a hand wheel for initiating a rotational movement in the end of a shaft-like or roller-like component, in particular in the end of a holder for a revolving card index.

PRIOR ART

Hand wheels of the above mentioned type which consist of plastic and have a more or less smooth surface are known.

DESCRIPTION OF THE INVENTION

The object of the invention is to provide a hand wheel which is provided, in the region of its actuating surface, with means which make it easier to rotate the hand wheel by countering any occurrence of the hand which is gripping the hand wheel slipping on the hand wheel. This object is achieved according to the invention, in the case of a hand wheel of the type in question, in that the hand wheel has a basic body, an outer shell, which can be pushed onto the basic body, can be arrested by latching elements in the pushed-on state and has openings distributed over its circumference, and an elastomeric insert, which is arranged between the basic body and the outer shell and forms protuberances which project through the openings of the outer shell and enhance the grip of the hand wheel.

The hand wheel according to the invention is easy to operate. In contrast to a solution in which the hand wheel is in one piece and is provided with integral soft/resilient protuberances, the three-part configuration of the hand wheel according to the invention has the advantage that the tooling expense which is necessary for producing the hand wheel is comparatively low.

Further details and features of the invention can be gathered from the subclaims and the following description of an embodiment of the invention illustrated in the attached drawing, in which:

METHODS OF IMPLEMENTING THE INVENTION

Figure 1:
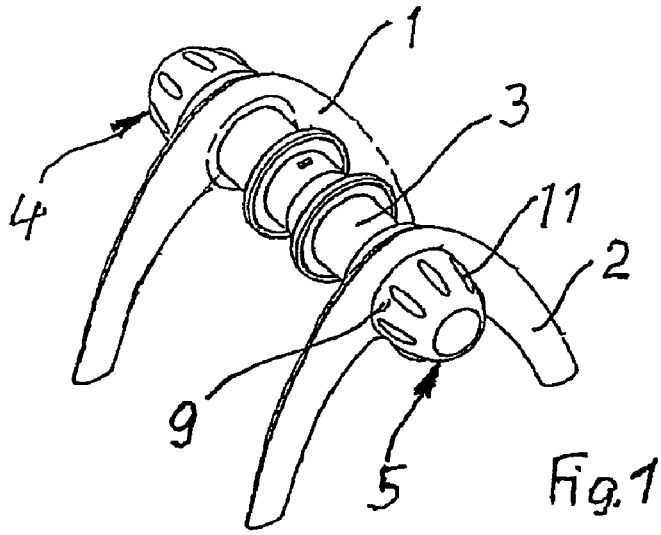
FIG. 1 shows a stand for a revolving card index with two hand wheels.
Figure 2:
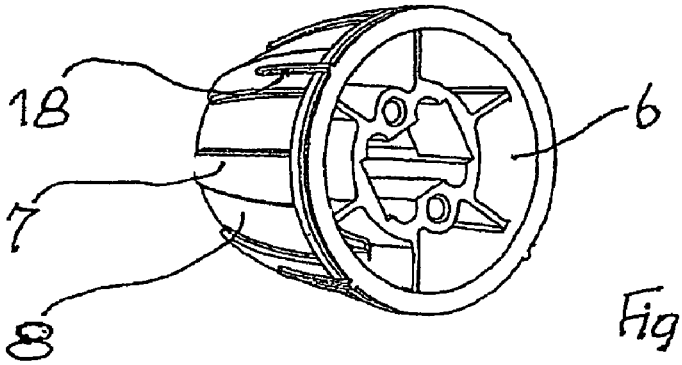
FIG. 2 shows the perspective view of the basic body of one of the hand wheels according to FIG. 1.
Figure 3:
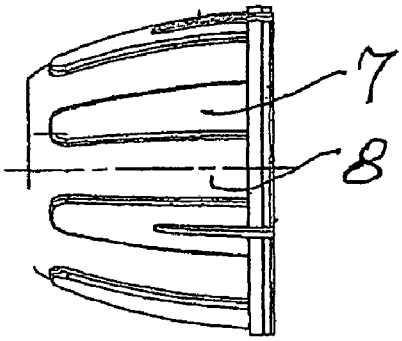
FIG. 3 shows a side view of the basic body according to FIG. 2.
Figure 4:
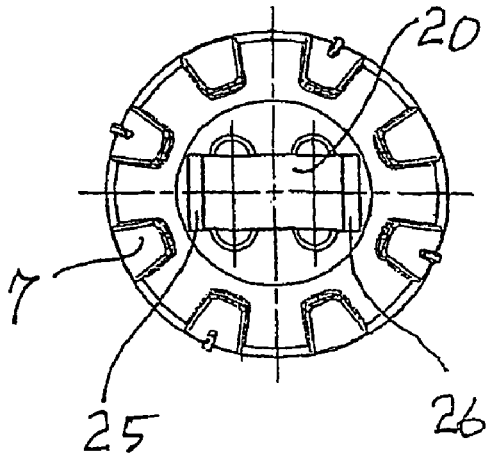
FIG. 4 shows the end view of the basic body according to FIG. 2.
Figure 5:
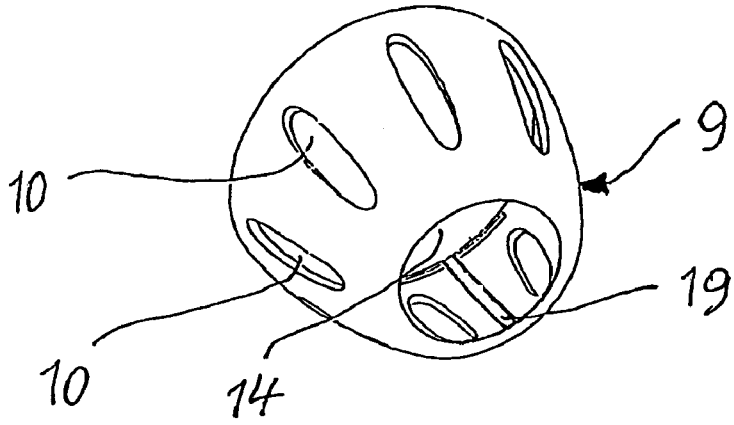
FIG. 5 shows the perspective view of the outer shell of one of the hand wheels.

The stand of a revolving card index which is illustrated in FIG. 1 is provided with a holder 3 which is mounted in a rotatable manner between two supports 1 and 2 and is intended for information carriers (not illustrated). Two hand wheels 4 and 5 are arranged at the opposite ends of the holder, and the construction of these hand wheels can be gathered from FIG. 2.

Each of the two hand wheels has a basic body 6 which, in the region of its circumference, has cutouts 8 which are separated from one another by supporting ribs 7. An outer shell 9 can be pushed onto the basic body 6, and this outer shell 9 is provided, in the region of its circumference, with openings 10 through which protuberances 11 of an insert 12 made of elastomeric material project beyond the outer surface of the outer shell 9.

Figure 6:
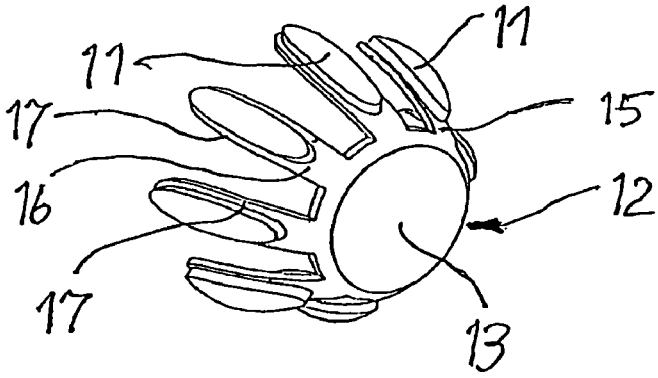
FIG. 6 shows the perspective view of an insert which ends up located between the basic body and the outer shell.

As can be seen from FIG. 6, the insert has a disk-like central part 13, which serves for covering an opening 14 of the outer shell 9, said opening being located in the region of the end side of the basic body 6. The disk-like central part 13 is adjoined, via film hinges 15, by extension arms 16 which bear the protuberances 11. The protuberances 11 are enclosed all the way round by supporting flanges 17 which, in the installed state, position themselves against the inner surface of the outer shell 9. In order for it to be possible for the outer shell 9 to be positioned correctly on the basic body 6, the latter is provided with guide ribs 18 which fit in guide grooves 19 on the inner wall of the outer shell 9.

Figure 7:
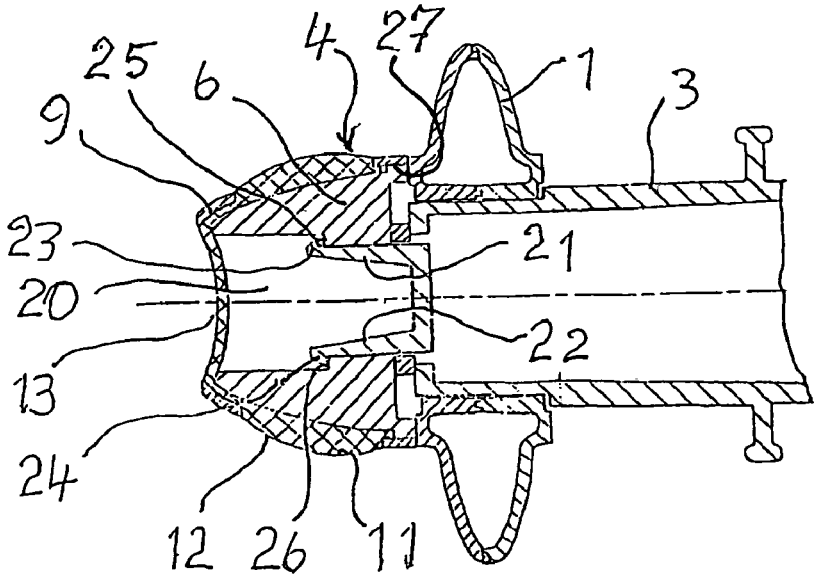
FIG. 7 shows a section through the end of the holder which can be made to rotate by the hand wheels and belongs to the stand of a revolving card index which is illustrated in FIG. 1.

FIG. 7 shows the connection between the hand wheel 4 and the holder 3 of the stand according to FIG. 1. Projecting into a central shaft 20 of the basic body 6 are two resilient retaining tongues 21, 22 which, at their ends, have latching protrusions 23, 24 which engage behind two latching stops 25, 26 located on mutually opposite shaft walls. In order for it to be possible to separate the hand wheel 4 from the holder 3, the outer shell 9, together with the insert 12, is drawn off from the basic body 6, on which it is normally retained by a latching connection which is indicated at 27.

The invention claimed is:

1. A hand wheel for initiating a rotational movement in the end of a shaft-shaped or roller-shaped component, said hand wheel having a basic body (6), and an outer shell (9) which can be pushed onto the basic body (6) and which can be arrested on said basic body (6) by latching elements in the pushed-on state, said outer shell (9) having openings (10) distributed over the circumference of said outer shell (9), said hand wheel further having an elastomeric insert (12), which is arranged between the basic body (6) and the outer shell (9) and forms protuberances (11) which project through the openings (10) of the outer shell (9) and enhance the grip of the hand wheel, characterized in that the insert (12) has a disk-shaped central part (13) which covers a central opening (14) of the outer shell (9), said central opening being located in the region of the end side of the basic body (6), said central part (13) being adjoined by extension arms (16) which form the protuberances (11).

2. The hand wheel as claimed in claim 1, characterized in that the basic body (6) is provided on the circumference of said basic body (6) with cutouts (8) which are separated from one another by supporting ribs (7) for the outer shell (9) and are intended for accommodating the extension arms (16) of the insert (12).

3. The hand wheel as claimed in claim 2, characterized in that the extension arms (16) are connected to the disk-shaped central part (13) of the insert (12) via film hinges (15).

4. The hand wheel as claimed in claim 2, characterized in that the extension arms (16) are provided with supporting flanges (17) which enclose the protuberances (11) and butt against the inner wall of the outer shell (9).

5. The hand wheel as claimed in claim 2, characterized in that the basic body (6) is provided on the circumference of said basic body (6) with guide ribs (18) which fit in guide grooves (19) on the inner wall of the outer shell (9).

6. The hand wheel as claimed in claim 2, characterized in that the basic body (6) has a central shaft (20) which is aligned with the opening (14) of the outer shell (9).

7. The hand wheel as claimed in claim 6, characterized in that the central shaft (20) has an essentially rectangular cross section and at least one of the walls of said central shaft (20) is provided with said latching elements formed by a latching stop (25, 26) and a latching protrusion (23, 24) of at least one shaft-mounted or roller-mounted retaining tongue (21, 22).

8. The hand wheel as claimed in claim 1, characterized in that the extension arms (16) are connected to the disk-shaped central part (13) of the insert (12) via film hinges (15).

9. The hand wheel as claimed in claim 8, characterized in that the extension arms (16) are provided with supporting flanges (17) which enclose the protuberances (11) and butt against the inner wall of the outer shell (9).

10. The hand wheel as claimed in claim 8, characterized in that the basic body (6) is provided on the circumference of said basic body (6) with guide ribs (18) which fit in guide grooves (19) on the inner wall of the outer shell (9).

11. The hand wheel as claimed in claim 8, characterized in that the basic body (6) has a central shaft (20) which is aligned with the opening (14) of the outer shell (9).

12. The hand wheel as claimed in claim 11, characterized in that the central shaft (20) has an essentially rectangular cross section and at least one of the walls of said central shaft (20) is provided with said latching elements formed by a latching stop (25, 26) and a latching protrusion (23, 24) of at least one shaft-mounted or roller-mounted retaining tongue (21, 22).

13. The hand wheel as claimed in claim 1, characterized in that the extension arms (16) are provided with supporting flanges (17) which enclose the protuberances (11) and butt against the inner wall of the outer shell (9).

14. The hand wheel as claimed in claim 13, characterized in that the basic body (6) is provided on the circumference of said basic body (6) with guide ribs (18) which fit in guide grooves (19) on the inner wall of the outer shell (9).

15. The hand wheel as claimed in claim 13, characterized in that the basic body (6) has a central shaft (20) which is aligned with the opening (14) of the outer shell (9).

16. The hand wheel as claimed in claim 15, characterized in that the central shaft (20) has an essentially rectangular cross section and at least one of the walls of said central shaft (20) is provided with said latching elements formed by a latching stop (25, 26) and a latching protrusion (23, 24) of at least one shaft-mounted or roller-mounted retaining tongue (21, 22).

17. The hand wheel as claimed in claim 1, characterized in that the basic body (6) is provided on the circumference of said basic body (6) with guide ribs (18) which fit in guide grooves (19) on the inner wall of the outer shell (9).

18. The hand wheel as claimed in claim 17, characterized in that the basic body (6) has a central shaft (20) which is aligned with the opening (14) of the outer shell (9).

19. The hand wheel as claimed in claim 1, characterized in that the basic body (6) has a central shaft (20) which is aligned with the opening (14) of the outer shell (9).

20. The hand wheel as claimed in claim 19, characterized in that the central shaft (20) has an essentially rectangular cross section and at least one of the walls of said central shaft (20) is provided with said latching elements formed by a latching stop (25, 26) and a latching protrusion (23, 24) of at least one shaft-mounted or roller-mounted retaining tongue (21, 22).

21. A hand wheel for initiating a rotational movement in the end of a holder for a revolving card index, said hand wheel having a basic body (6), and an outer shell (9) which can be pushed onto the basic body (6) and which can be arrested on said basic body (6) by latching elements in the pushed-on state, said outer shell (9) having openings (10) distributed over the circumference of said outer shell (9), said hand wheel further having an elastomeric insert (12), which is arranged between the basic body (6) and the outer shell (9) and forms protuberances (11) which project through the openings (10) of the outer shell (9) and enhance the grip of the hand wheel, characterized in that the insert (12) has a disk-shaped central part (13) which covers a central opening (14) of the outer shell (9), said central opening being located in the region of the end side of the basic body (6), said central part (13) being adjoined by extension arms (16) which form the protuberances (11).

* * * * *